US005787337A

United States Patent [19]

Matsuno et al.

[11] Patent Number: 5,787,337

[45] Date of Patent: Jul. 28, 1998

[54] METHOD OF FABRICATING A FIELD-EMISSION COLD CATHODE

[75] Inventors: Fumihiko Matsuno; Nobuya Seko, both of Tokyo, Japan

[73] Assignee: NEC Corporation, Tokyo, Japan

[21] Appl. No.: 593,371

[22] Filed: Jan. 29, 1996

[30] Foreign Application Priority Data

Jan. 30, 1995 [JP] Japan ..... 7-013127

[51] Int. Cl.[6] ..... H01J 9/02

[52] U.S. Cl. ..... 445/50; 445/58

[58] Field of Search ..... 445/50, 24, 58

[56] References Cited

U.S. PATENT DOCUMENTS 5,136,764 8/1992 Vasquez ..... 445/50
5,151,061 9/1992 Sandhu ..... 445/50 X
5,249,340 10/1993 Kane et al. ..... 445/50 X
5,628,661 5/1997 Kim et al. ..... 445/24

FOREIGN PATENT DOCUMENTS 6-89651 3/1994 Japan .
6-96664 4/1994 Japan .

*Primary Examiner*—Kenneth J. Ramsey
*Attorney, Agent, or Firm*—Young & Thompson

[57] ABSTRACT

In a field-emission cold cathode forming an emitter by the vacuum deposition method, contamination at the side surface of the insulating layer due to deposition of an emitter material during formation of the emitter is prevented. Thereby, deterioration of insulating resistance and dielectric strength between gate and emitter can also be prevented. With an oblique vacuum deposition, a sacrificing layer 5 is formed onto the entire area of the side surface within the cavity 4, an emitter is then vacuum deposited, and thereafter emitter material particles are removed together with the protecting film.

10 Claims, 5 Drawing Sheets

METHOD OF FABRICATING A FIELD-EMISSION COLD CATHODE

BACKGROUND OF THE INVENTION

1. Field of the Invention

The present invention relates to a method of fabricating a cold cathode which is used as an electron emission source and particularly to a method of fabricating a field-emission cold cathode for emitting electron from a sharpened tip end.

2. Description of the Related Art

A so-called Spindt type cold cathode is disclosed in Journal of Applied Physics, Vol. 39, No. 7, pp. 3504, 1968.

This Spindt type cold cathode provides a higher current density than a hot cathode and is characterized in having small velocity distribution of electrons emitted. Moreover, in comparison with single field-emission emitter, this cold cathode provides a small current noise and operates with a voltage as low as several tens voltage to 200 V. Furthermore, this cold cathode operates under the vacuum condition of about $10^{-10}$ torr in the electron microscope. However, in this case, it can be operated, based on the report:, within the glass tube of $10^{-6}$ to $10^{-8}$ torr with a plurality of emitters.

FIG. 5 shows a cross-section of the principal structure of the Spindt type cold cathode as the related art. A miniaturized conic emitter 102 in height of about 1 μm is formed on a conductive substrate 101 by the vacuum deposition method and a gate layer 103 and an insulating layer 104 are formed around the emitter 102. The substrate 101 and emitter 102 are electrically connected and a DC voltage of about 100 V is applied across the substrate 101 (and emitter 102) and the gate layer 103 (positive side). Since a distance between the substrate 101 and gate layer 103 is set approximately to 1 μm, an aperture diameter of the gate layer is as narrow as about 1 μm and the end point of the emitter 102 is sharpened, an intensive field is applied to the end point of the emitter 102. When the field becomes 2 to $5\times10^7$ V/cm or higher, the emitter 102 emits electrons from the end point providing a current of 0.1 to several 10 μA per emitter. Arrangement of a plurality of miniaturized cold cathodes having such a structure on a substrate 101 in the form of array will constitute a flat type cathode for emitting a large current.

A method of fabricating the Spindt type cold cathode will be explained with reference to FIG. 6. An insulating layer 62 such as silicon dioxide ($SiO_2$) and a low resistance gate layer 63 which will become a gate electrode are formed on a conductive substrate 61 of silicon which also works as a cathode electrode (FIG. 6A). Next, the cavity 65 (FIG. 6B) patterned on the resist 64 by the photolithography technology, etc. is transferred to the gate layer 63 and insulating layer 62 by the etching method (FIG. 6C).

Next, in view of forming a sacrificing layer 66 for layer lift-off on the gate layer 63 and at the edge of the cavity 65, the aluminum oxide is vacuum deposited from the oblique direction while the substrate 61 is being rotated (FIG. 6D). Thereafter, in order to form an emitter, an emitter material 67 such as molybdenum is vacuum deposited in vertical for the substrate (FIG. 6E). In this case, since the aperture of cavity is gradually narrowed with progress of vacuum deposition, a conic emitter 68 is formed on the bottom surface of cavity. Finally, the sacrifice layer 66 is etched to remove the unwanted film at the surface and to expose the emitter 68 (FIG. 6F).

For the operation of the field-emission cold cathode, about 100 V is applied across the electrodes providing a distance of approximately 1 μm. Therefore, insulation characteristic between the gate layer and emitter is very important. If insulation between gate and emitter is poor, operation is not stable and operation life is also shortened.

In the method of related arts, an almost conic emitter electrode is formed in just the upper direction by the vacuum deposition method, but all evaporated atoms are not deposited as the emitter electrode but a little fraction of emitter material is also deposited to the side surface of insulating layer within the cavity, thereby deteriorating the insulation characteristic between the gate layer and emitter. Moreover, a Japanese Unexamined patent Laid-Open No. Hei 6-89651 discloses the art to form the emitter electrode with various materials by a sputtering method. In the sputtering method, however, the degree of vacuum is lower than that of the vacuum deposition method and scattering of vacuum deposition particles due to the fact that a gas molecule gives higher influence. Thereby, deposition of the emitter material to the side surface of the insulating layer increases, deteriorating the insulation characteristic to a large extent. This influence particularly results in distinctive deterioration of the insulation characteristic and sometimes disables the operation itself for the cathode in the constitution where many emitters are arranged in parallel.

A Japanese Unexamined Patent Laid-Open No. Hei 6-96664 discloses a method of fabricating Spindt type cold cathode. In this method, on the occasion of forming a sacrificing layer with the oblique vacuum deposition method as shown in FIG. 6D, only a part of the side surface of the insulating layer is covered with the sacrificing layer. Accordingly, when vacuum deposition is carried out thereafter, the emitter material is deposited on the greater part of the other side surface of the insulating layer and thus make it almost impossible to expect improvement in the insulation characteristic.

SUMMARY OF THE INVENTION

In the method of the present invention, a protecting film is formed on the entire surface or greater surface of the side surface of the insulating layer before vacuum deposition of emitter material to allow deposition of the emitter material on the protecting film in the subsequent vacuum deposition process and to remove, after formation of the emitter, such protection film together with the deposited material.

That is, the method of fabricating field-emission cold cathode of the present invention comprises the steps of:

forming both an insulating layer and a conductive gate layer on a conductive subscriber or a substrate where a conductive layer is deposited on the insulating material;

forming a cavity to form an emitter electrode on this insulating layer and conductive gate layer;

forming a sacrificing layer; and removing the sacrificing layer, after an emitter electrode is formed within the cavity by depositing the emitter electrode material, to lift off the extra emitter electrode material;

the method further comprising a step of;

forming a protection film, before deposition of the emitter electrode material, to the side surface of the insulating layer surrounding the emitter electrode and removing the protection film after the emitter electrode material is deposited.

At the time of forming a sacrificing layer, while the substrate is rotated around the vertical axis, the sacrificing layer material is deposited at an angle of about $\tan^{-1}$ ($D_g/(t_g+t_i)$) from the rotating axis to the sacrificing layer material deposited at the side surface of the insulating layer within the cavity as the protecting film. Moreover, after the protection film is formed by the CVD method, the protection film deposited on the area of the substrate where the emitter electrode should be formed is removed, leaving the protection film only at the side surface of the insulating layer. Otherwise, it is also possible that a protection film is deposited by the vacuum deposition method or sputtering method and the film deposited to the side surface of the insulating layer in the cavity scattered on the occasion of removing the protection film, by the sputter etching method, deposited on the region of the substrate where the emitter electrode is to be formed is used as the protection film.

Since the cold cathode may be formed without contamination of side surface of the insulating layer with a conductive emitter material, the insulation resistance between emitter and gate is not deteriorated and dielectric strength is also not affected. Thereby, a gate current during operation can be reduced and stable operation can be assured. Moreover, a cold cathode having matrix-arrayed emitters can operate stably with increase of an emission current.

BRIEF DESCRIPTION OF THE DRAWINGS

Other objects and advantages of the present invention will be apparent from the following detailed description of the presently preferred embodiments thereof, which description should be considered in conjunction with the accompanying drawings in which.

DETAILED DESCRIPTION OF THE PREFERRED EMBODIMENTS

Figure 1A:
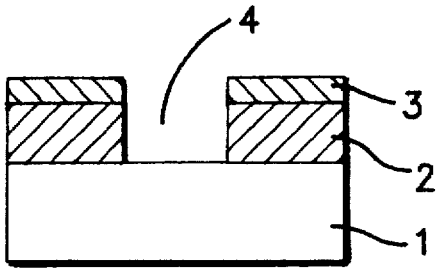
FIGS. 1A to 1D are diagrams for explaining the steps of manufacturing a Field-emission cold cathode of the first embodiment of the present invention.

The present invention will be explained in detail with reference to the accompanying drawings. FIG. 1 illustrates a constitution and processes of a field-emission cold cathode showing a first embodiment of the present invention. As illustrated in FIG. 1A, an insulating layer 2 (thickness $t_i$=about 0.8 μm) and a gate layer 3 (thickness $t_g$=about 0.2 μm) are stacked on a silicon substrate 1 and a minute cavity 4 (diameter $D_g$=about 1 μm) is formed on the gate layer 3 and insulating layer 2 by the photolithography and etching process. As the material of the insulating layer 2 and gate layer 3, silicon dioxide or tungsten, for example, is used.

Next, a sacrificing layer 5 is formed. In this case, while the substrate 1 is rotated around the axis perpendicular thereto, aluminum is vacuum deposited.

Figure 1B:
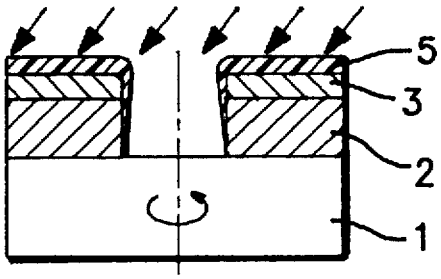

In this process, the vacuum deposition is carried out in the incident angle of $\tan^{-1}(D_g/(t_g+t_i))$ (in this case, about 45 degrees from the rotating axis) so that aluminum is deposited on the entire part of the gate layer 3 and side surface of the insulating layer 2 within the cavity 4 to cause the sacrificing layer 5 to work also as a protection film (FIG. 1B). Thereby, the aluminum layer formed covers to the side surface of the insulating layer in the cavity 4 from about the gate layer 3 to the substrate 1. Usually, diameter $D_g$ of the cavity 4 is about 0.2 to 2 μm and height of emitter ($= t_i+t_g$) is set to 0.8 to 2 times the diameter $D_g$. Therefore, the optimum $\tan^{-1}(D_g/t_g+t_i)$ is in the range of 25 to 50 degrees. Typically, the preferential angle is about 45 degrees.

Figure 1C:
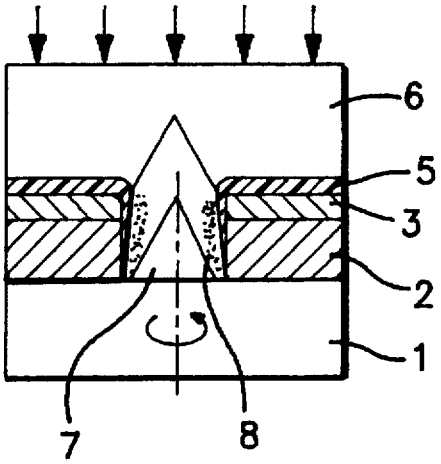
Figure 1D:
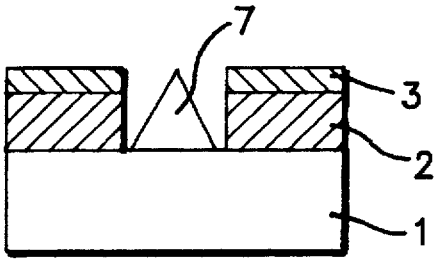

Thereafter, while the substrate 1 is rotated around the axis perpendicular thereto, molybdenum is vacuum deposited at normal, incidence above the substrate 1 to form an emitter 7. During this process, emitter material particles 8 migrating due to scattering of residual gas in the vacuum condition are adhered to the sacrificing layer (protection film) 5 on the side surface of the insulating layer (FIG. 1C). Finally, the sacrificing layer 5 is dissolved by phosphoric acid to remove unwanted emitter material 6 and emitter material particles 8 in order to realize non-contaminated side surface of the insulating layer (FIG. 1D).

As the emitter material, gold, platinum, rhodium can be used as well as molybdenum, while as the gate layer material, tungsten silicide, molybdenum, polycrystal silicon can be used as well as tungsten, as the insulating layer material, silicon nitride, etc. can be used as well as silicon dioxide, and as the sacrificing layer material, aluminum oxide, silicon nitride, nickel can be used as well as aluminum. Moreover, as the substrate material, those obtained by depositing a conductive layer on the insulating material may be used. In this case, it is not particularly required to add special steps to form and remove the protecting film in the first embodiment and the purpose can be attained by the conventional formation of the sacrificing layer and etching of the sacrificing layer.

Figure 2A:
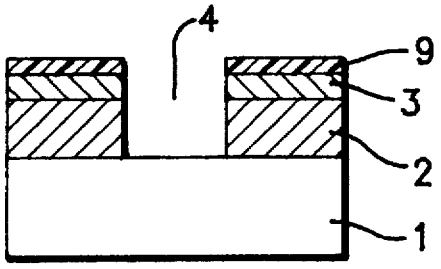
FIGS. 2A to 2C are diagrams for explaining the steps of fabricating a field-emission cold cathode of the second embodiment of the present invention.
Figure 2B:
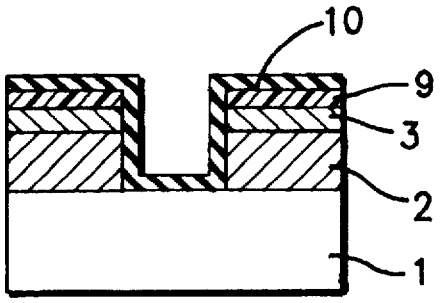

FIG. 2 illustrates a constitution and processes of a field-emission cold cathode showing the second embodiment of the present invention. In FIG. 2, the elements like those of FIG. 1 are designated by the like reference numerals. Moreover, the material and the size of each constitutional element are the same as those in the first embodiment shown in FIG. 1. As shown in FIG. 2, an insulating layer 2, a gate layer 3 and sacrificing layer 9 of aluminum are stacked and a minute cavity 4 is formed to the sacrificing layer 9, gate layer 3 and insulating layer 2 (FIG. 2A). Subsequently, aluminum which will become a protection film material 10 is formed on the gate layer 3 and on the surface of cavity 4 by using a CVD method (FIG. 2B).

Figure 2C:
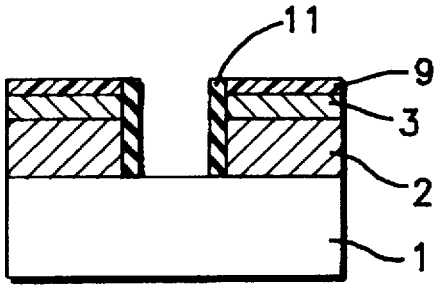
Figure 3A:
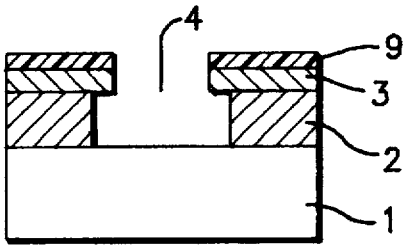
FIGS. 3A to 3E are diagrams for explaining the steps of fabricating a field-emission cold cathode of the third embodiments of the present invention.
Figure 3B:
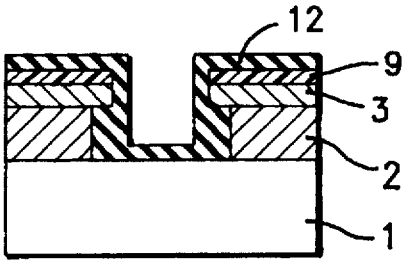
Figure 3C:
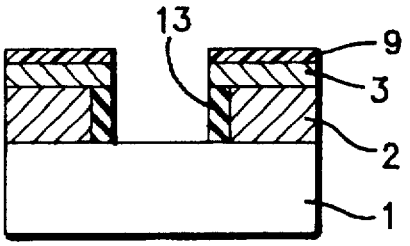
Figure 3D:
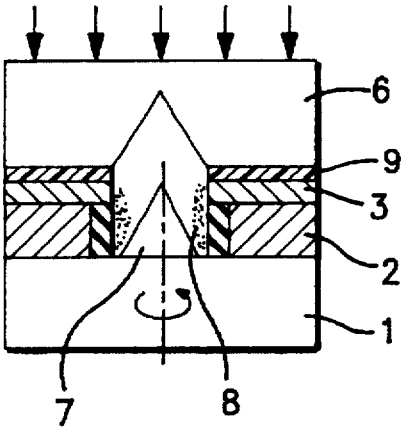
Figure 3E:
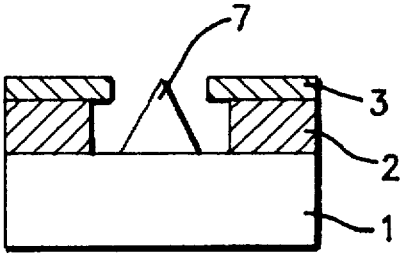

Thereafter, the protection film 11 is left only at the side surface of the insulating layer 2, gate layer 3 and sacrificing layer 9 by performing anisotropic etching with the reactive ion etching (RIE) utilizing carbon tetrachloride gas to expose the bottom surface of the cavity 4 (FIG. 2C). Processes after formation of the emitter are the same as the first embodiment shown in FIGS. 1C and 1D.

In the above explanation, aluminum is used as the material of sacrificing layer and protecting film, but aluminum oxide, silicon nitride or a combination thereof can also be used additionally by replacing an introduced gas at the time of CVD or RIE.

FIG. 3 illustrates a constitution and processes of a field-emission cold cathode showing the third embodiment of the present invention. The processes up to formation of the cavity 4 are the same as those of the second embodiment of FIG. 2A. Subsequently, the side surface of the insulating layer is etched with fluoric acid to form the shape formed by eaves of the gate layer as shown in the figure (FIG. 3A). Thereafter, the upper and side surfaces and the bottom surface of the cavity 4 are coated with a positive resist 12 (FIG. 3B) and the resist 12 is left, as the protection film 13, only in the area which is shadowed at the time of exposure by the exposure and development from above the substrate (FIG. 3C). The processes up to separation of the sacrificing layer from formation of the emitter (FIG. 3D) are the same as those of the first embodiment shown in FIGS. 1C and 1D. Finally, the contamination-free side surface of the insulating layer can be realized by removing the protection film 13 by using the remover (FIG. 3E).

Figure 4A:
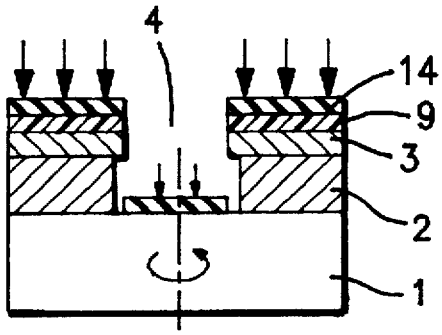
FIGS. 4A to 4C are diagrams for explaining the steps of fabricating a field-emission cold cathode of the fourth embodiment of the present invention.
Figure 4B:
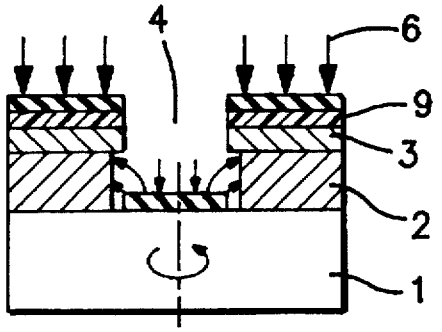
Figure 4C:
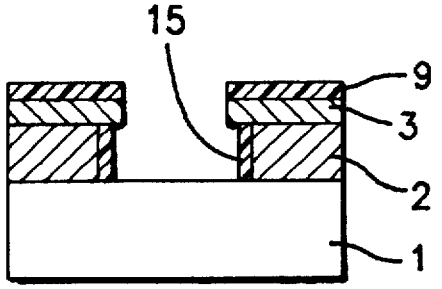
Figure 5:
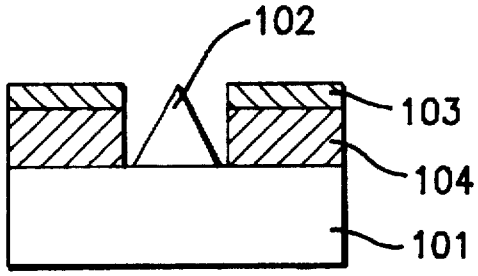
FIG. 5 PRIOR ART
FIG. 5 is a cross-sectional view of the principal portion of the Spindt type cold cathode.
Figure 6A:
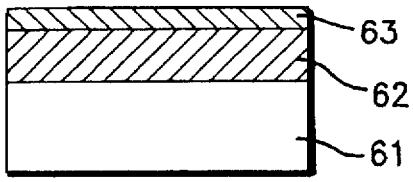
FIG. 6A PRIOR ART
FIGS. 6A to 6F are diagrams for explaining the steps of fabricating the Spindt type cold cathode disclosed in the related art, Japanese Unexamined Patent Laid-Open No. Hei6-96664.
Figure 6B:
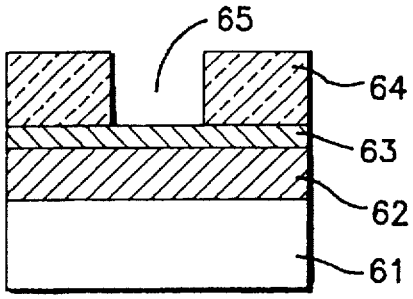
FIG. 6B PRIOR ART
Figure 6C:
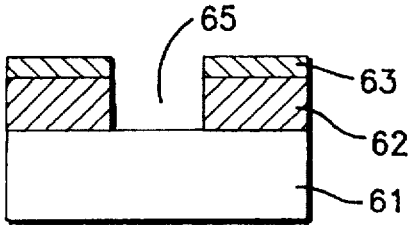
FIG. 6C PRIOR ART
Figure 6D:
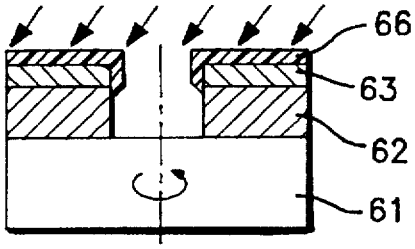
FIG. 6D PRIOR ART
Figure 6E:
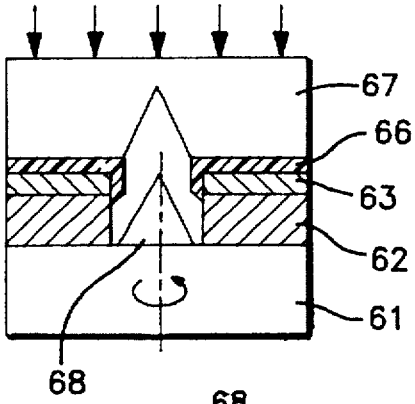
FIG. 6E PRIOR ART
Figure 6F:
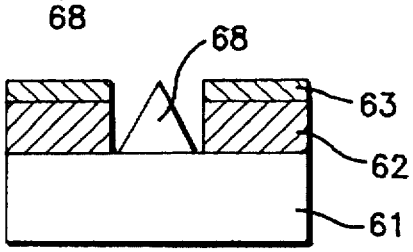
FIG. 6F PRIOR ART

FIG. 4 illustrates a constitution and processes of a field-emission cold cathode showing the fourth embodiment of the present invention. The processes up to the etching for the side surface of the insulating layer are the same as those in the third embodiment. Moreover, the protection film material (aluminum) 14 is vacuum deposited in the vertical direction with respect to the substrate 1 (FIG. 4A). Thereafter, the sputter etching is performed using argon ion. The sputter etched protection material 14 at the bottom surface of the cavity 4 is removed and is then adhered to the side surface of the insulating layer as the protection film 15 (FIG. 4C). The processes after formation of the emitter are the same as those of the first embodiment shown in FIGS. 1C and 1D.

As explained heretofore, the present invention can prevent the deposition of emitter material onto the side surface of the insulating layer to fabricate cold cathode without deterioration of the insulating characteristic. As a result, discharge and leak currents particularly generated when the emitters are matrix-arrayed can be reduced to increase an emission current and also improve the characteristic yield.

Moreover, deterioration of insulating characteristic due to deposition can be prevented at the time of forming an emitter electrode by the sputtering method. Therefore, the range for selection of emitter material can easily be widened up to a high melting point compound which is difficult to be used to form a film by the vacuum deposition method.

Although preferred embodiments of the present invention have been described and illustrated, it will be apparent to those skilled in the art that various modifications may be made without departing from the principles of the invention. The embodiments of the invention in which an exclusive property or privilege is claimed are defined as follows:

What is claimed is:

1. A method of fabricating a field-emission cold cathode comprising the steps of:

forming an insulating layer on a substrate having a conductive surface;

forming a conductive gate layer on said insulating layer;

forming a cavity in said insulating layer and conductive gate layer;

forming a sacrificing layer on said gate layer;

forming a protecting film on a side surface of said insulating layer within the cavity by coating a positive photoresist;

forming an emitter electrode within the cavity by depositing emitter electrode material; and removing said protecting film and said sacrificing layer together with extra emitter electrode material.

2. A method of fabricating a field-emission cold cathode as claimed in claim 1, wherein said sacrificing layer is formed by using a vacuum deposition method while said substrate is rotated around an axis perpendicular thereto, and material of said sacrificing layer is deposited at an angle of about $\tan^{-1}(D_g/(t_g+t_i))$ from said axis when said cavity has a diameter designated as $D_g$, and said gate layer and insulating layer have thicknesses $t_g$ and $t_i$, respectively, to form both of said sacrificing layer and said protecting film.

3. A method of fabricating a field-emission cold cathode as claimed in claim 2, wherein said material of said sacrificing layer covers the side surface of the insulating layer in the cavity from the gate layer to the substrate.

4. A method of fabricating a field-emission cold cathode as claimed in claim 2, wherein said angle is set in the range of 25 to 50 degrees.

5. A method of fabricating a field-emission cold cathode as claimed in claim 1, wherein said protecting film is formed by a CVD method, said protecting film deposited on an area of said substrate is removed by using one of methods selected from sputter etching method and anisotropic dry etching method.

6. A method of fabricating a field-emission cold cathode comprising the steps of:

forming an insulating layer on a substrate having a conductive surface;

forming a conductive gate layer on said insulating layer;

forming a cavity in said insulating layer and conductive gate layer;

forming a sacrificing layer on said gate layer;

forming a protecting film on a side surface of said insulating layer within the cavity by providing material of said protecting film at the bottom of said cavity and sputtering said material;

forming an emitter electrode within the cavity by depositing emitter electrode material; and removing said protecting film and said sacrificing layer together with extra emitter electrode material.

7. A method of fabricating a field-emission cold cathode as claimed in claim 6, wherein said sacrificing layer is formed by using a vacuum deposition method while said substrate is rotated around an axis perpendicular thereto, and material of said sacrificing layer is deposited at an angle of about $\tan^{31\ 1}(D_g/(t_g+t_i))$ from said axis when said cavity has a diameter designated as $D_g$, and said gate layer and insulating layer have thicknesses $t_g$ and $t_i$, respectively, to form both of said sacrificing layer and said protecting film.

8. A method of fabricating a field-emission cold cathode as claimed in claim 7, wherein said material of said sacrificing layer covers the side surface of the insulating layer in the cavity from the gate layer to the substrate.

9. A method of fabricating a field-emission cold cathode as claimed in claim 7, wherein said angle is set in the range of 25 to 50 degrees.

10. A method of fabricating a field-emission cold cathode as claimed in claim 7, wherein said protecting film is formed by a CVD method, said protecting film deposited on an area of said substrate is removed by using one of methods selected from sputter etching method and anisotropic dry etching method.

* * * * *